US005586588A

United States Patent [19]

Knox

[11] Patent Number: 5,586,588

[45] Date of Patent: Dec. 24, 1996

[54] APPARATUS AND METHOD FOR PRESSURIZING AND DRAFTING LIQUID CONTAINED WITHIN FOOD-GRADE CONTAINERS

[76] Inventor: Lee B. Knox, 310 Adams Ave., Endicott, N.Y. 13760

[21] Appl. No.: 361,204

[22] Filed: Dec. 21, 1994

[51] Int. Cl.[6] ..... B65B 1/04; B65B 3/04; B67C 3/00

[52] U.S. Cl. ..... 141/285; 141/4; 141/18; 141/21; 141/54; 141/64; 141/234; 141/237; 141/242; 141/301

[58] Field of Search ..... 141/4, 18, 21, 141/39, 54, 63, 64, 234, 237, 242, 243, 285, 301, 302, 46, 35; 222/400.7, 399, 136, 400.8

[56] References Cited

U.S. PATENT DOCUMENTS

| | | | |
|---|---|---|---|
| 3,410,456 | 11/1968 | Johnson, Jr. et al. | 222/82 |
| 3,527,391 | 9/1970 | Di Muria | 222/400.7 |
| 3,592,351 | 7/1971 | Johnson, Jr. | 220/27 |
| 3,604,602 | 9/1971 | Lee | 222/400.7 |
| 4,000,829 | 1/1977 | Johnson, Jr. et al. | 220/265 |
| 4,022,347 | 5/1977 | Noble | 222/400.8 |
| 4,082,206 | 4/1978 | Patzke et al. | 222/400.7 |
| 4,706,847 | 11/1987 | Sankey et al. | 222/1 |
| 4,836,414 | 6/1989 | Credle, Jr. et al. | 222/400.7 |
| 4,838,324 | 6/1989 | Boyd | 141/64 |
| 4,867,209 | 9/1989 | Santoiemmo | 141/19 |
| 4,934,543 | 6/1990 | Schmidt | 215/228 |
| 5,186,362 | 2/1993 | Biagi, Jr. | 222/399 |
| 5,329,975 | 7/1994 | Heitel | 141/17 |

OTHER PUBLICATIONS pamphlet entitled "The Carbonator", 1 pg.
publication entitled "Beverage Sphere Gas Tap Tapping Instructions", 4 pgs.
newsletter entitled "The Party Kegs", publ. LD Carlson Co. dd. Nov. 30, 1993, 1 pg.
sales brochure publ. Crosby & Baker LTD, 2 pgs.
instructional manual, identified as "GAM", 1 pg.

*Primary Examiner*—Henry J. Recla
*Assistant Examiner*—Timothy L. Maust
*Attorney, Agent, or Firm*—Oldham & Oldham Co., L.P.A.

[57] ABSTRACT

An apparatus and method for pressurizing liquid contained within a single, food-grade container or a series of such containers from an external source of gas, and for drafting liquid from the container (s). $CO_2$ may be used to carbonate liquids such as beer or soft drinks, or alternatively air or inert gases may be used in conjunction with non-carbonated liquids such as wine.

According to a preferred embodiment the disclosed apparatus, which may be used with a single container or each one of a series of containers, comprises a cap screwed onto the container neck and a nipple assembly attached to the neck via the cap. The nipple assembly includes a body section and a plurality of nipples attached thereto. Each nipple has an outer portion protruding externally of the container, an inner portion disposed within the container and an interior flow passage extending through both portions. An annular seal is disposed so as to prevent fluid leakage between the body section and the container neck. The outer portions of each nipple are adapted to receive a tube which is fluidly coupled to either an external source of gas, a dispensing device, or a nipple of the apparatus attached to an adjacent container. The inner portion of one of the nipples is adapted to receive a draw tube immersed in the liquid. A check valve is optionally included and cooperates with the inner portion of at least one of the nipples to permit fluid flow into the container while preventing the escape of fluid through the corresponding nipple(s).

According to an alternative embodiment, an apparatus and method is provided for creating a portable source of pressurized gas.

21 Claims, 4 Drawing Sheets

APPARATUS AND METHOD FOR PRESSURIZING AND DRAFTING LIQUID CONTAINED WITHIN FOOD-GRADE CONTAINERS

BACKGROUND OF THE INVENTION

1. Field of the Invention

The present invention relates to an apparatus and method for pressurizing liquid within a container and drafting the liquid from the container. More particularly, the apparatus and method of the present invention have particular use in carbonating and drafting liquids such as beer and soda from plastic or glass food-grade containers.

2. Related Art

The use of one, two and three liter plastic bottles, having a removable threaded cap, has become increasingly popular throughout the soda industry for retaining carbonated liquids. A known problem associated with such containers is that the soda residing near the bottom of the container tends to become flat, due to loss of carbonation, if the bottle is left uncapped for a period of time or if the contents are emptied over a period of time requiring a number of cap removals and associated depressurizations.

A related problem exists in the home brewing industry which, prior to this invention, has lacked means for carbonating beer contained in a conveniently sized container which may be kept in conventional home-use refrigerators, and a means for drafting the beer from the same container while maintaining the carbonation. Known devices in the home brewing industry include those which utilize relatively small $CO_2$ cartridges, which allow carbonation of liquid within a container. However, these devices typically do not permit attachment to a relatively large external source of $CO_2$ and typically do not permit a series plumbing arrangement for drafting liquid from a series of containers. Additionally, many do not permit drafting the liquid from even a single container while maintaining the $CO_2$ pressure within the container. Another known device in the home brewing industry resolves the problem of series hook-up of several containers and also provides the ability to draft liquid from the containers while maintaining $CO_2$ pressure within the container. However, this device is directed for use with relatively large spherical containers, not suitable for storage in conventional home-use refrigerators, and the device is not adaptable for use with commercially available food-grade plastic or glass containers such as the commonly used one, two and three liter plastic soda containers.

In view of the deficiencies associated with known beverage pressurizing and drafting devices, applicants invention is herein presented.

SUMMARY OF THE INVENTION

Accordingly, the present invention is directed to an apparatus and method for use in pressurizing and drafting liquid contained within one or more containers, with each container including a neck portion having external threads. According to a preferred embodiment, the apparatus comprises a cap having internal threads which are adapted to threadingly engage the external threads of the neck portion of the container, and a fluid fitting assembly secured to the neck portion by the cap. The fluid fitting assembly includes a body section and a fitting attached to the body section, with the fitting being operable for accepting a fluid from an external source for injection into the container. The fluid fitting assembly further includes a means for dispensing fluid from the container, with the dispensing means being attached to the body section.

In other preferred embodiments the apparatus may comprise the following additional structural features and functions. The fluid fitting assembly may comprise a nipple assembly, which extends through a central opening in the cap, with the fitting comprising a first nipple and the dispensing means comprising a second nipple. The first and second nipples each include an outer portion attached to and protruding from an outer surface of the body section and disposed externally of the container and an inner portion attached to and protruding from an inner surface of the body section within the interior portion of the container. The apparatus may further comprise a draw tube having a first end attached to an interior portion of the second nipple, a second end immersed in the liquid, and an .interior flow passage extending longitudinally between the first and second ends. Bach nipple includes an interior flow passage extending through the inner and outer portions with the interior flow passage of the first nipple being in fluid flow communication with the external source of fluid and the interior flow passage of the second nipple being in fluid flow communication with the interior flow passage of the draw tube, such that the draw tube and second nipple combine to permit at least a portion of the liquid to be dispensed from the container through the exterior portion of the second nipple.

The cap may include a generally cylindrical body section with internal threads formed thereon and an annular flange attached to and protruding radially from the body section toward the central opening. The nipple assembly includes an annular flange attached to and circumventing the body section with the annular flange of the nipple assembly disposed inward of and in radially overlapping relationship with the annular flange of the cap. The apparatus may further include an annular seal surrounding the body section of the nipple assembly and disposed inward of the annular flange of the nipple assembly. The annular flange of the cap urges the seal into sealing engagement with the flange of the nipple assembly and the neck portion of the container when the cap is screwed onto the neck portion.

The apparatus may also include a check valve disposed within the neck portion of the container and attached to the nipple assembly. The check valve has a generally circular shape and is made of a resilient elastomeric material which is impermeable to the flow of gas therethrough. The check valve flexes away from the inner portion of the first nipple so as to permit fluid to flow through the first nipple into the container when the pressure within the interior flow passage of the first nipple exceeds the pressure within the interior of the container by a first predetermined differential pressure. The check valve is urged against the inner portion of the first nipple, so as to close the interior flow passage of the first nipple, thereby preventing fluid to flow outward through the first nipple when the pressure within the container exceeds the pressure within the interior flow passage of the first nipple by a second predetermined differential pressure. The check valve includes first and second spaced apart openings which are urged onto the inner portion of the second nipple and a center post protruding from the inner surface of the body section, respectively. The inner portion of the second nipple includes a means for retaining the check valve, comprising at least one outwardly facing barb fitting. The outer portion of the first and second nipples each comprise a plurality of inwardly facing barb fittings which permit pressurized tubes, which are preferably flexible, to be attached to the outer portions of each nipple. The barb fittings of the first nipple cooperate with a flexible tube attached thereto to avoid an over-pressure condition within the container by permitting leakage between the fittings and the tube when the pressure within the tube is large enough to cause the inside diameter of the tube to expand away from the fittings. Alternatively, when rigid tubes are attached to the outer portions of the nipples, a separate, in-line pressure relief valve may be included in the gaseous supply line to the first nipple, so as to avoid an over-pressure condition within the container. The nipple assembly may be made of a one-piece construction of molded plastic.

According to another preferred embodiment, the method of the present invention is directed to a method for pressurizing and drafting a fluid contained within and partially filling a food-grade container which includes a neck portion having external threads, and the method comprising the steps of: assembling a pressurizing and drafting assembly; attaching the pressurizing and drafting assembly to the neck portion of the container; pressurizing the liquid within the container with gas form an external source of gas; and drafting at least a portion of the liquid from the container.

According to other preferred embodiments, the method of the present invention may include the following additional steps. The step of assembling the pressurizing and drafting assembly comprises the steps of: installing a check valve onto a nipple assembly; inserting the nipple assembly into a generally cylindrical body section of a cap, with the cap body section having internal threads formed thereon; pressing a seal into the cap in surrounding relationship with the body section of the nipple assembly; and attaching a first end of a hollow draw tube to an inner portion of the nipple assembly. The step of attaching the pressurizing and drafting assembly comprises the step of screwing the cap onto the neck portion of the container so as to attach the body section of the nipple assembly and the seal to the neck portion and to dispose a second end of the draw tube within the liquid in the container.

The step of pressurizing comprises the steps of attaching a tube to an outer portion of a first one of the nipples and injecting gas from the external source of gas through the interior flow passage of the first nipple into a cavity within the interior of the container, with the cavity being located outward of and in fluid flow communication with the liquid within the container. The step of drafting comprises the steps of connecting a tube to the outer portion of the second nipple and to a dispensing device, and opening the dispensing device.

According to other preferred embodiments, the method of the present invention is directed to a method for pressurizing and drafting liquid contained within each of a series of food-grade containers and includes the steps of providing a series fluid coupling of the pressurizing and drafting assemblies attached to each container so as to establish a liquid flow communication of the liquid contained in any one of the containers of the series with the liquid contained in each of the successive ones of the containers. The method may further include the step of simultaneously carbonating the liquid within each container.

BRIEF DESCRIPTION OF THE DRAWINGS

The structural features and functions, as well as the method steps, of the present invention will become more apparent from the following detailed description of the preferred embodiments when taken in conjunction with the accompanying drawings, wherein.

DETAILED DESCRIPTION OF THE DRAWINGS

Figure 1:
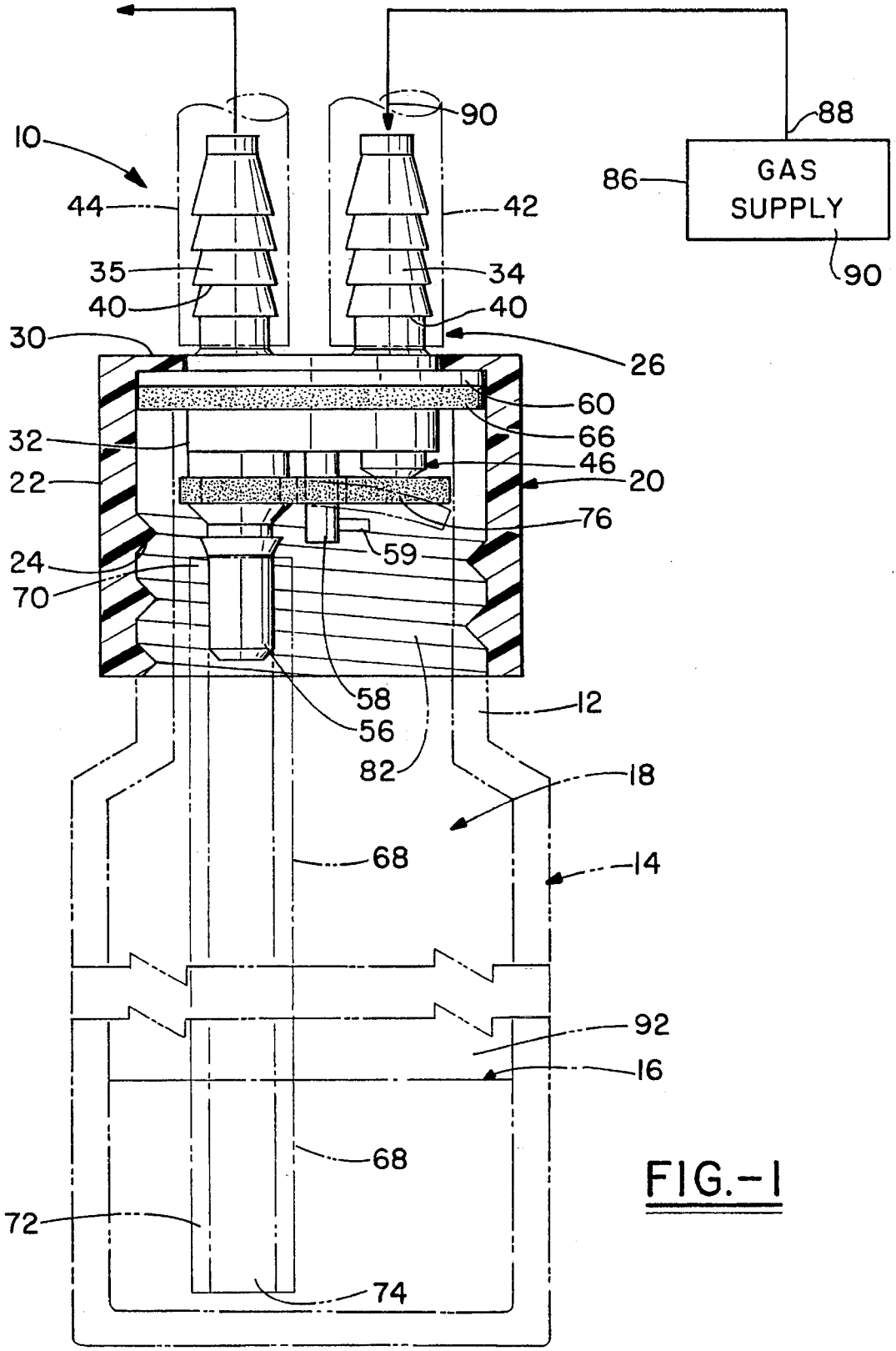
FIG. 1 is an elevational view, partly in section, illustrating the pressurizing and drafting apparatus of the present invention.
Figure 2:
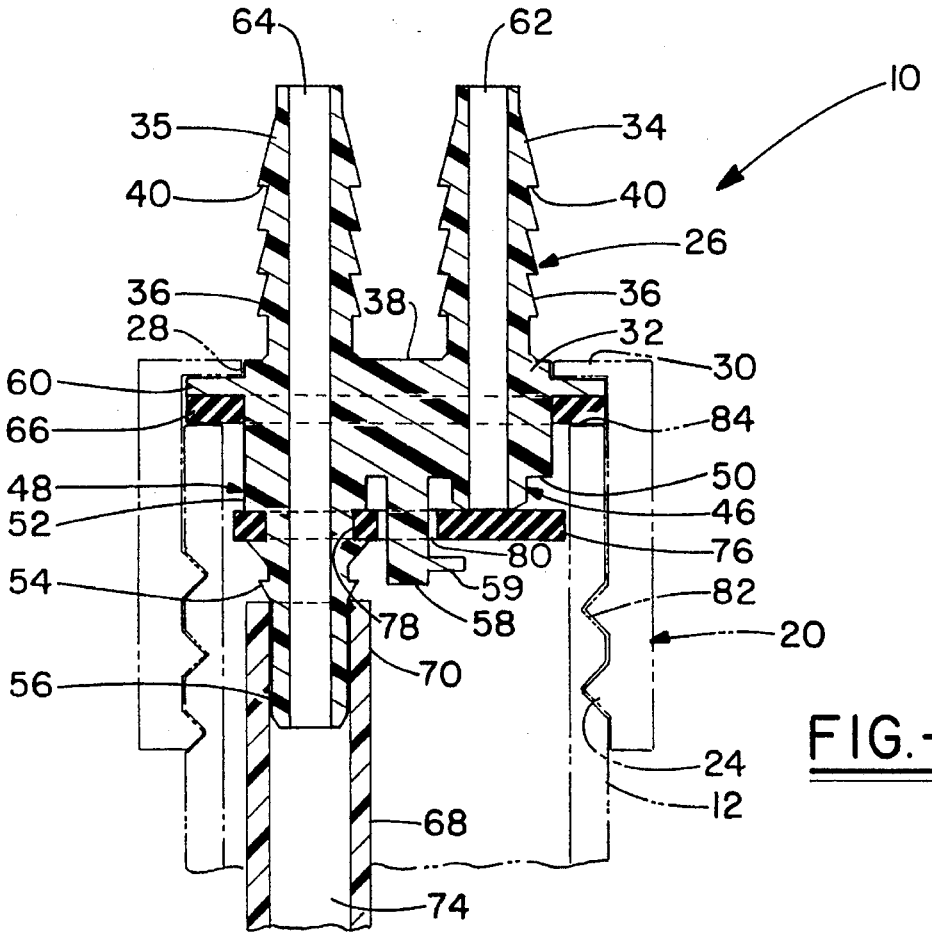
FIG. 2 is an elevational sectional view of the pressurizing and drafting assembly shown in FIG. 1.

Referring now to the drawings, wherein like reference numerals have been used for common elements throughout, FIGS. 1 and 2 illustrate a pressurizing and drafting assembly 10 according to a preferred embodiment of the present invention. Pressurizing and drafting assembly 10 is attached to a neck portion 12 of container 14 and may be used to pressurize a liquid 16 contained within an interior portion 18 of container 14, and to draft the liquid 16 from container 14, as subsequently discussed. Preferably, each assembly 10 is used with a container 14 comprising a commercially available food-grade, plastic or glass container, such as those which are commonly used to contain carbonated sodas, and having a liquid storage capacity ranging from about 0.2 liters to about 4.0 liters, and more preferably is used with commonly available containers 14 having a capacity of 20 ounces, 1.0 liter, 2.0 liters or 3.0 liters. However, assembly 10 may be advantageously utilized with containers of the type having a neck portion with external threads and a liquid capacity outside of the preferred range, made of plastic, glass or even other suitable materials. Assembly 10 includes a cap 20 having a generally cylindrical body section 22, with internal threads 24 formed thereon, and a fluid fitting assembly comprising nipple assembly 26. Cap 20 further includes a central opening 28 which receives nipple assembly 26 and an annular flange 30 which is attached to and protrudes radially from body section 22 towards central opening 28. Nipple assembly 26 includes a body section 32 and a pair of nipples 34 and 35 which are attached to body section 32. Each nipple 34 and 35 includes an outer portion 36 which is attached to an outer surface 38 of body section 32 and protrudes outward from surface 38 externally of the container 14. Outer portions 36 comprise a plurality of inwardly facing barb fittings 40 which are each configured with a generally frusto-conical shape which permits pressurized tubes 42 and 44 to be attached to nipples 34 and 35, respectively as shown in FIG. 1. Tubes 42 and 44 are preferably flexible tubes and may be made of an elastomeric material, with the frustoconical shaped barb fittings 40 providing a sealing engagement with tubes 42 and 44. Alternatively, tubes 42 and 44 may comprise rigid or semi-rigid tubes. In this instance, a gasket, or seal, (not shown) may be disposed between the outer surface of barb fittings 40 and the inner surface of the rigid or semi-rigid tubes 42 and 44. Conventional clamps (not shown) may be used to further secure the rigid or semi-rigid tubes 42 and 44 to nipples 34 and 35, respectively. It is noted that exterior portion 36 of nipple 34 is the same as exterior portion 36 of nipple 35. Nipples 34 and 35 further include an inner portion 46 and 48, respectively, which are structurally different from one another for subsequently described purposes. Inner portions 46 and 48 are attached to inner surface 50 of body section 32 and protrude from surface 50 within the neck portion 12 of container 14. Inner portion 46 of nipple 34 comprises a generally cylindrical disk while inner portion 48 of nipple 35 includes an outer disk portion 52, a plurality of outwardly facing barb fittings 54, and an inner, generally cylindrical portion 56. Nipple assembly 26 further includes a center post 58 which is attached to and protrudes from inner surface 50 of body section 32, and an outer, annular flange 60 attached to and circumventing body section 32. Nipple assembly 26 also includes a radially extending tab 59 which is attached to center post 58, for a subsequently described purpose. Nipples 34 and 35 further include interior flow passages 62 and 64, respectively. Flow passage 62 extends through outer portion 36 and inner portion 46 of nipple 34 and similarly, flow passage 64 extends through outer portion 36 and inner portion 48 of nipple 35. Body section 32, nipples 34 and 35, center post 58 and annular flange 60 of nipple assembly 26 are preferably made of a one-piece construction of molded plastic.

Pressurizing and drafting assembly 10 further includes an annular seal 66 surrounding the body section 32 of nipple assembly 26 and disposed inward of annular flange 60 of nipple assembly 26. Assembly 10 further includes a hollow draw tube 68 having a first end 70 which is attached to the inner portion 48 of nipple 35 and a second end 72 which is immersed in the liquid 16 within container 14 when assembly 10 is secured to neck portion 12 of container 14. Draw tube 68 further includes an interior flow passage 74 extending between end 70 and opposing end 72. Assembly 10 may optionally include a check valve 76 which is attached to nipple assembly 26 and disposed within neck portion 12 of container 14 when assembly 10 is attached to neck portion 12. Check valve 76 has a generally circular shape and includes a pair of spaced apart openings or through holes 78 and 80 which receive the inner portion 48 of nipple 35 and center post 58, respectively. The diameter of hole 78 is slightly larger than the outside diameter of cylindrical portion 56 of inner portion 48 of nipple 35 but is smaller than the maximum outside diameter of barb fittings 54. Accordingly, barb fittings 54, which are disposed inward of check valve 76, serve as a means for retaining check valve 76 on nipple assembly 26. The diameter of hole 80 is slightly larger than the outside diameter of center post 58 with center post 58 and hole 80 combining to provide the proper positioning of check valve 76 with respect to nipple assembly 26. Tab 59 is disposed inward of check valve 76 and protrudes radially outward from center post 58 beyond hole 80. Accordingly, tab 59 also provides a means for retaining check valve 76 on nipple assembly 26.

The elements of pressurizing and drafting assembly 10 are assembled, prior to attaching assembly 10 to container 14, according to the following steps which comprise a portion of the inventive method of the present invention. Check valve 76 is installed onto nipple assembly 26 by forcing the inner portion 48 of nipple 35 through hole 78, inserting center post 58 and tab 59 through hole 80, and disposing check valve 76 in abutting relationship with inner portion 46 of nipple 34. As a next step, nipple assembly 26 and check valve 76 are inserted into the body section 22 of cap 20. Next, annular seal 66 is pressed into the body section 22 of cap 20. Seal 66 includes a central opening which receives body section 32 of nipple assembly 26 so that seal 66 is disposed in surrounding relationship with body section 32. Seal 66 is disposed inward of and adjacent to annular flange 60 which circumvents body section 32. Next, the first end 70 of hollow draw tube 68 is attached to the inner portion 48 of nipple 35. More specifically, end 70 slidingly engages the inner cylindrical portion 56 of inner portion 48 and is disposed inward of barb fittings 54 which have a maximum diameter which is larger than the diameter of flow passage 74 of draw tube 68. At this point, the preassembly of the constituent elements of assembly 10 to one another has been completed. Next, pressurizing and drafting assembly 10 is attached to neck portion 12 of container 14, which comprises the step of screwing cap 20 onto neck portion 12 so as to attach body section 32 of nipple assembly 26 and seal 66 to neck portion 12 and to dispose a second end 72 of draw tube 68 within the liquid 16 in container 14. During the step of screwing cap 20 onto neck portion 12, the internal threads 24 of cap 20 engage external threads 82 formed on the exterior surface of neck portion 12, so as to secure cap 20 to neck 2 as shown in FIG. 2. As shown in FIGS. 1 and 2, annular flange 60 of nipple assembly 26 is disposed inward of and in radially overlapping relationship with flange 30 of cap 20, and annular seal 66 is generally concentric with flange 60. Accordingly, as cap 20 is screwed onto neck portion 12 of container 14 flange 30 of cap 20 urges flange 60 of nipple assembly 26 against seal 66 which in turn urges seal 66 into sealing engagement with neck portion 12 of container 14, and flange 60. More specifically, seal 66 is in sealing engagement with the outward facing circular outer surface or lip 84 of neck portion 12 and with the inner annular surface of flange 60. It should be understood that the size of selected elements of assembly 10 may be adjusted as required to match the size of the particular container 14 to which assembly 10 is attached. For instance, the inside diameter of the cylindrical body section 22 of cap 20 may be adjusted as required so that the internal threads 24 of cap 20 match the external threads 82 formed on neck portion 12. Additionally, the outside diameters of flange 60 and seal 66 may be adjusted as required so that the peripheries of flange 60 and seal 66 are disposed in close proximity with the inner surface of the cylindrical body section 22 of cap 20.

Figure 3:
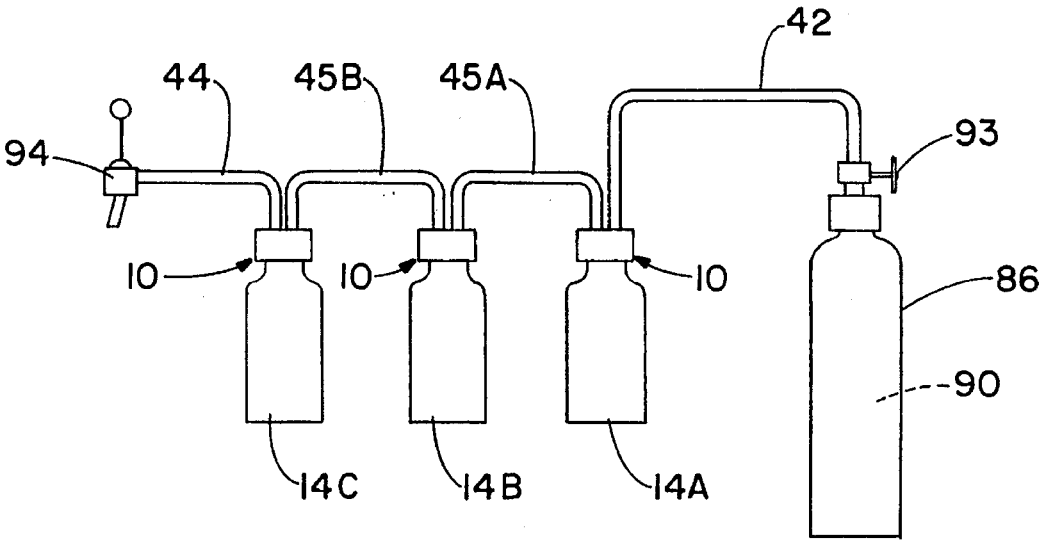
FIG. 3 is a view illustrating the pressurizing and drafting assembly shown in FIGS. 1 and 2 in conjunction with each of a series of containers.

After pressurizing and drafting assembly 10 has been attached to neck portion 12 of container 14, assembly 10 may be used to pressurize the liquid 16 within container 14, from an external source of gas 86, and to draft at least a portion of the liquid 16 from the container 14. The step of pressurizing liquid 16 comprises the steps of attaching tube 42 to the outer portion 36 of nipple 34, as shown in FIG. 1 with tube 42 surrounding barb fittings 40, and attaching the other end of tube 42 to the external source of gas 86 as indicated schematically at 88 in FIG. 1. The pressurizing step further includes the step of injecting gas 90, contained within source 86, through tube 42 and through the interior flow passage 62 of nipple 34 into cavity 92 within the interior of container 14. Cavity 92 is located outward of and in fluid flow communication with liquid 16 within container 14. The external source of gas 86 may comprise, but is not limited to, a relatively large cylinder, such as a commercially available cylinder having a five pound capacity and includes a pressure regulating valve 93 with tube 42 attached to the output of regulator 93 as shown in FIG. 3 (which illustrates a subsequently discussed series plumbing arrangement of a series of containers 14). It should be understood that the apparatus and method of the present invention may be advantageously utilized in conjunction with an external source of gas 86 having a different size and shape provided there is a sufficient quantity of gas 90 contained therein. An additional, optional, in-line pressure regulator (not shown) may be included at a location downstream of regulator 93 with tube 42 replaced by a pair of tubes to accommodate the additional regulator. When tube 42 comprises a flexible tube, the barb fittings 40 of the outer portion 36 of nipple 34 cooperate with flexible tube 42 so as to avoid an over-pressure condition within container 14 by permitting leakage between fittings 40 and the flexible tube 42 when the pressure of gas 90 within hose 42 is large enough to cause the inside diameter (not shown) of tube 42 to expand away from the outside surface of fittings 40. Accordingly, fittings 40 of nipple 34 cooperate with flexible tube 42 so as to provide the function of a conventional relief valve, thereby providing a safety feature, in addition to regulator 93, for avoiding an over-pressurization of container 14. The pressure required to create the leakage of gas 90 between fittings 40 and flexible tube 42 varies with the mechanical properties of tube 42 as well as the temperature of tube 42. Accordingly, the material for tube 42 is selected so as to ensure an adequate margin of safety, with respect to the allowable pressure within container 14, throughout the expected operating temperature range. Alternatively, when tube 42 comprises a rigid or semi-rigid tube, a separate, conventional in-line relief valve may be provided between nipple 34 and the external source of gas 86 so as to avoid an over-pressure condition within container 14. The choice of gas 90 within container 86 is dependent upon the desired results to be achieved with assembly 10. For instance, if the liquid 16 within container 14 is beer or other carbonated fluid such as beer, sodas or soft drinks, gas 90 comprises pressurized $CO_2$. Alternatively, if liquid 16 comprises a non-carbonated liquid such as wine, gas 90 may comprise either pressurized inert gas or pressurized air. Accordingly, the step of injecting gas into cavity 92 comprises the step of injecting either $CO_2$, inert gas, or air into cavity 92. When liquid 16 comprises a carbonated fluid such as beer or soda, the step of pressurizing may comprise the step of carbonating liquid 16 which in turn comprises the step of injecting $CO_2$ through interior flow passage 62 of nipple 34 into cavity 92 and bubbling the $CO_2$ through liquid 16 for a predetermined period of time which is required to fully carbonate liquid 16, before completing the step of drafting liquid 16 from container 14. The step of drafting liquid 16 from container 14 comprises the steps of connecting one end of tube 44 to the outer portion 36 of nipple 35 and connecting the other end of tube 44 to a dispensing device 94 (not shown in FIG. 1), such as a conventional drafting faucet as shown in FIG. 3, and opening dispensing device 94.

Check valve 76 has a generally circular shape and is made of a resilient material, preferably an elastomeric material, which is substantially impermeable to the flow of liquid and gas therethrough. Accordingly, during the step of injecting pressurized gas 90 through interior flow passage 62 of nipple 34 and into cavity 92, check valve 76 flexes away from the inner portion 46 of nipple 34 as shown in phantom in FIG. 1, provided that the pressure differential between the pressure within flow passage 62 and that within cavity 92 is above a predetermined amount which is anticipated to be in a range of approximately 2–4 psig. However, the particular differential pressure required to cause check valve 76 to flex away from inner portion 46 may vary with application, but is intended to be as close to zero as is practical. When gas 90 is not being injected into cavity 92 and tube 42 has been removed from nipple 34, the static pressure within cavity 92 will typically be above the ambient pressure within flow passage 62. The pressure differential between cavity 92 and flow passage 62, or the resilient nature of check valve 76, or both, causes check valve 76 to be in abutting relationship with the inner portion 46 of nipple 34 as shown in solid in FIG. 1 when gas 90 is not being injected into container 14. The inner surface of inner portion 46 comprises a very smooth surface, which is accomplished by conventional methods, so that check valve 76 seals off the inner end of interior flow passage 62 and prevents gas 90 from escaping the interior of container 14 through nipple 34 when gas 90 is not being injected into container 14. Check valve 76 is most preferably made of a fluorosilicone rubber having a durometer rating of 40 or less which further enhances the sealing engagement of check valve 76 against the inner portion 46 of nipple 34 during those periods when gas 90 is not being injected into container 14.

A plurality of pressurizing and drafting assemblies 10 may be used to pressurize and draft liquid contained within each of a series of food-grade containers illustrated by containers 14A, 14B and 14C in FIG. 3. Although three such containers are shown in FIG. 3, it should be understood that the method of the present invention may be applied to different numbers of containers 14. As a first step in the method for pressurizing and drafting liquid from the series of containers 14, the constituent elements of each assembly 10, comprising nipple assembly 26, check valve 76, seal 66, draw tube 68 and cap 20 are assembled as discussed in previous paragraphs. Although not shown in detail in FIG. 3, each container 14 includes external threads 82 formed on the corresponding neck portion 12. As a next step in pressurizing and drafting the liquid 16 contained within each of the containers 14, each of the pressurizing and drafting assemblies 10 are attached to the corresponding one of containers 14A, 14B and 14C. The attaching step comprises the step of screwing cap 20 of each assembly 10 onto the neck portion 12 of the corresponding one of the containers 14 so that the internal threads 24 of each cap 20 threadingly engage the external threads 82 of the corresponding container 14. Next, the pressurizing and drafting assembly 10 which is attached to container 14A, comprising the first one of the series of containers 14, is coupled with the external source of pressurized gas 86. This is accomplished by connecting, or attaching a first end of tube 42 to the outer portion 36 of nipple 34 and attaching the other end of hose 42 to the output side of pressure regulator 93 which regulates the pressure of gas 90 as it exits the external source 86. Next, a series fluid coupling is provided among the plurality of assemblies 10 so as to establish a liquid flow communication of the liquid contained in any one of the containers 14 with the liquid contained in each downstream container 14. This is accomplished by attaching one end two of a tube 45 to the outer portion 36 of nipple 35 of a first, upstream assembly 10 and attaching the other end of tube 45 to the outer portion 36 of nipple 34 of the next consecutive, downstream one of containers 14. Accordingly, a first end of tube 45A is attached to nipple 35 of the assembly 10 which is attached to container 14A, and a second end of tube 45A is attached to nipple 34 of the assembly 10 which is attached to container 14B, which is downstream of container 14A. Similarly, tube 45B is attached to nipple 35 of the assembly 10 which is attached to container 14B and to nipple 34 of the assembly 10 which is attached to container 14C. Container 14B is downstream of container 14A and container 14C is downstream of container 14B due to the action of check valves 76 which prevent fluid, either gaseous or liquid, from flowing out of a given container 14 through nipple 34. Accordingly, either gas 90 or liquid 16 may flow from container 14A to 14B, and from container 14B to 14C, but may not flow in the opposite direction, for instance from container 14C to container 14B. In the illustrated example shown in FIG. 3, there is no container downstream of container 14C. Due to the foregoing attachments of tubes 45A and 45B, the liquid 16 within container 14A is fluidly coupled in series with the liquid contained within containers 14B and 14C, which are each downstream of container 14A. Similarly, the liquid 16 within container 14B is fluidly coupled in series with the liquid 16 contained within container 14C. Next, the liquid 16 contained within container 14A is pressurized, which comprises the step of flowing pressurized gas 90 from the external source of gas 86 through tube 42 and nipple 34 of the assembly 10 attached to container 14A into the cavity 92 disposed outward of and in flow communication with the liquid 16 within container 14A. The gas within container 14A is free to bubble into the liquid 16 within container 14A and escape through draw tube 68, nipple 35 and flexible tube 45A into the cavity 92 within container 14B and similarly, the gas may flow from container 14B to container 14C. Accordingly, after a period of time, a static pressure of the gas 90 within cavities 92 of containers 14A, 14B and 14C will reach an equilibrium value. As noted previously, the choice of gas 90 depends upon the ! particular liquid contained within containers 14A, 14B and 14C. If the liquid 16 comprises beer or carbonated soft drinks, gas 90 comprises $CO_2$, and alternatively, if the liquid 16 comprises non-carbonated liquids gas 90 may comprise either an inert gas or air. Next, liquid 16 is drafted from container 14C. The step of drafting comprises the step of attaching one end of tube 44 to the outer portion 36 of nipple 35 of the assembly 10 which is attached to container 14C and attaching the other end of tube 44 to dispensing device, or faucet 94. Tube 44 is installed prior to the step of pressurizing the containers 14. It should be understood that other forms of dispensing devices may be utilized. The step of drafting further comprises the step of opening the dispensing device, or faucet 94 and dispensing liquid 16 therefrom.

When gas 90 comprises $CO_2$, so as to pressurize a carbonated liquid, the step of pressurizing comprises the step of carbonating the liquid 16 within at least container 14A. This is accomplished by allowing the gas 90 to permeate into the liquid 16 within container 14A for a period of time. The liquid 16 within containers 14B and 14C may also be carbonated with the arrangement shown in FIG. 3, including draw tubes 68 as part of each assembly 10, but the time required to carbonate the liquid 16 within containers 14B and 14C may be longer than desired. Accordingly, the liquid 16 within each of the containers 14A, 14B and 14C may be carbonated by an alternative method comprising the following steps. First, each assembly 10 is assembled as discussed previously with the exception that the draw tube 68 is omitted. Next, each modified assembly 10, i.e. without draw tube 68, is attached to the corresponding container by screwing cap 20 onto the neck portion of the corresponding container 14A, 14B or 14C. Next, tubes 42, 45A, and 45B are installed as shown in FIG. 3. Tube 44 may be installed as shown in FIG. 3 or, more preferably, nipple 35 of the assembly 10 which is attached to container 14C may be capped. The next step comprises injecting gas 90, which comprises $CO_2$ in this case, through tube 42 into the cavity 92 within container 14A. Due to the lack of draw tube 68 in the assembly 10 which is attached to container 14A, the $CO_2$ is free to flow from the cavity 92 within container 14A through tube 45A into the cavity 92 within container 14B. Similarly, the $CO_2$ may flow through tube 45B into the cavity 92 within container 14C. In this manner, $CO_2$ is disposed above and in fluid flow communication with the liquid 16 within each of the containers 14A, 14B and 14C. The liquid 16 within each container may be carbonated by allowing the $CO_2$ to permeate into the liquid 16 within each container for a predetermined period of time. After this predetermined period of time, each assembly 10 is removed from the corresponding one of the containers 14, and a draw tube 68 is attached to the inner portion 48 of nipple 35 of each assembly 10, and each assembly 10 is reattached to the corresponding container 14. As long as this removal and reattachment of assemblies 10 are accomplished in a reasonable amount of time, no significant amount of carbonation will be lost from the liquid contained within each container 14. Tube 44 is then attached as shown in FIG. 3 and liquid 16 may be drafted from faucet 94 as discussed previously. An alternative method of simultaneously carbonating the liquid within each of a series of containers is provided in conjunction with the embodiments of the invention illustrated in FIGS. 4–6 and subsequently discussed.

During the drafting of liquid from faucet 94, liquid 16 is removed from the last container of the series comprising container 14C. However, due to the plumbing arrangement shown in FIG. 3, container 14A is the first container to be emptied of liquid 16. Next, container 14B is substantially emptied of liquid 16 and finally, container 14C is substantially emptied of liquid 16. It should be understood, that the containers 14A, 14B, and 14C are substantially emptied rather than absolutely emptied, due to the need to provide some clearance between the inner end 72 of draw tube 68 and the bottom of the corresponding containers, so as to allow the liquid 16 to flow into the draw tube 68.

Figure 5:
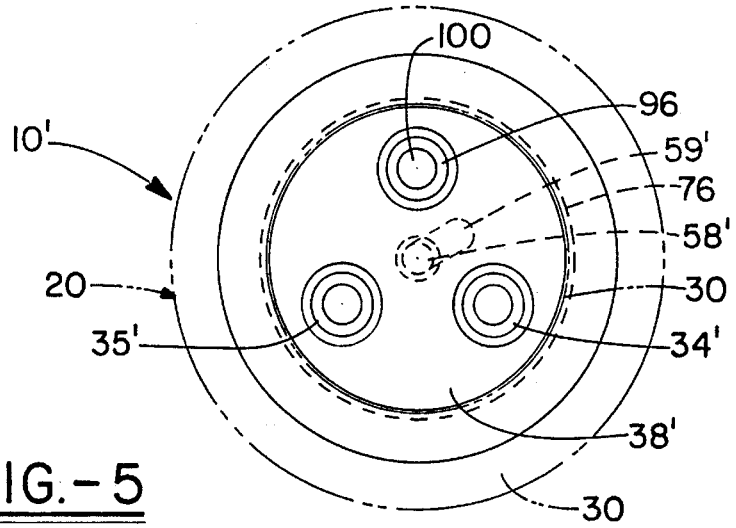
FIG. 5 is a plan view taken along line 5—5 in FIG. 4.
Figure 4:
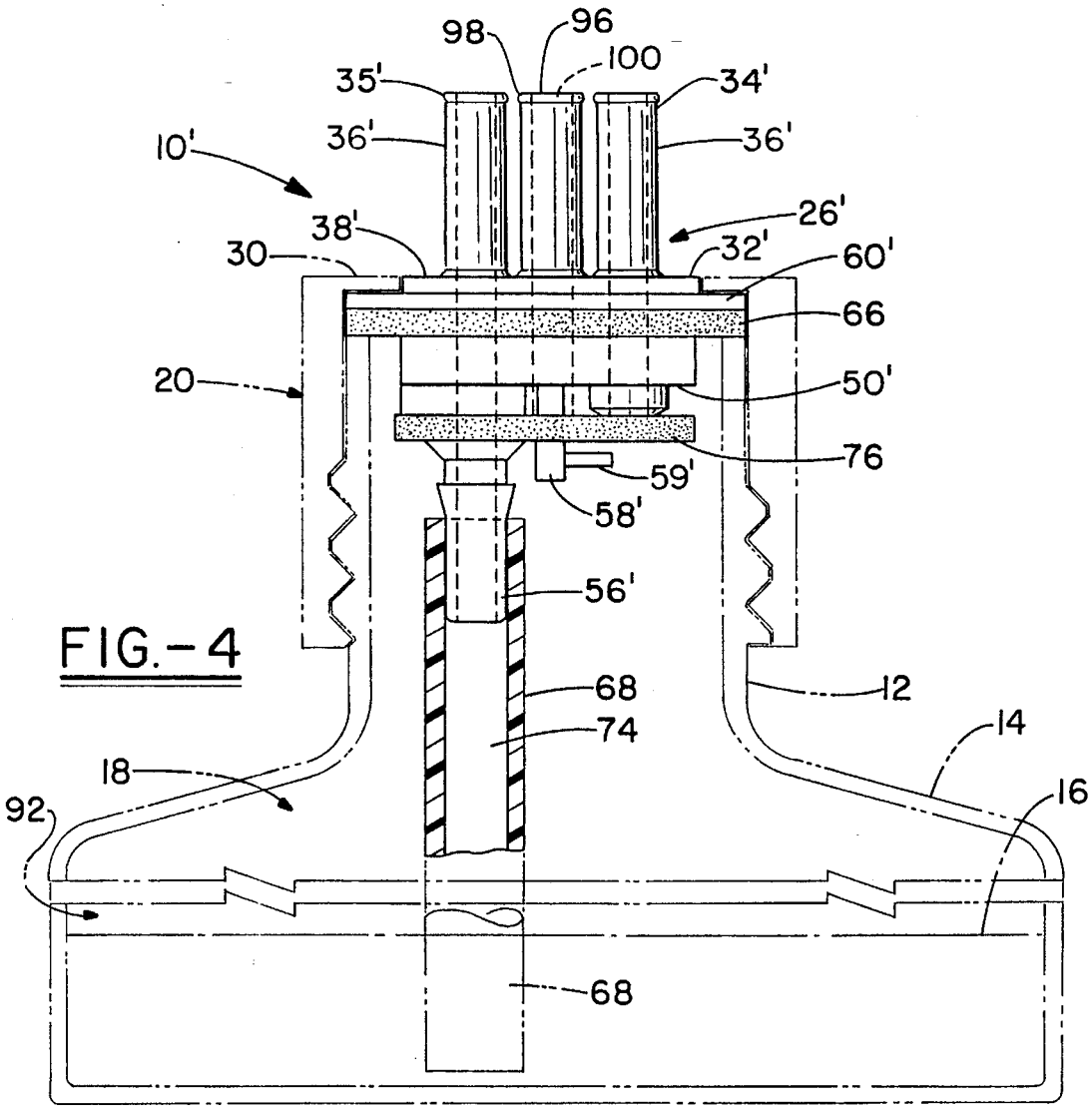
FIG. 4 is a longitudinal elevational view, partly in section, illustrating the pressurizing and drafting assembly according to an alternative embodiment.
Figure 6:
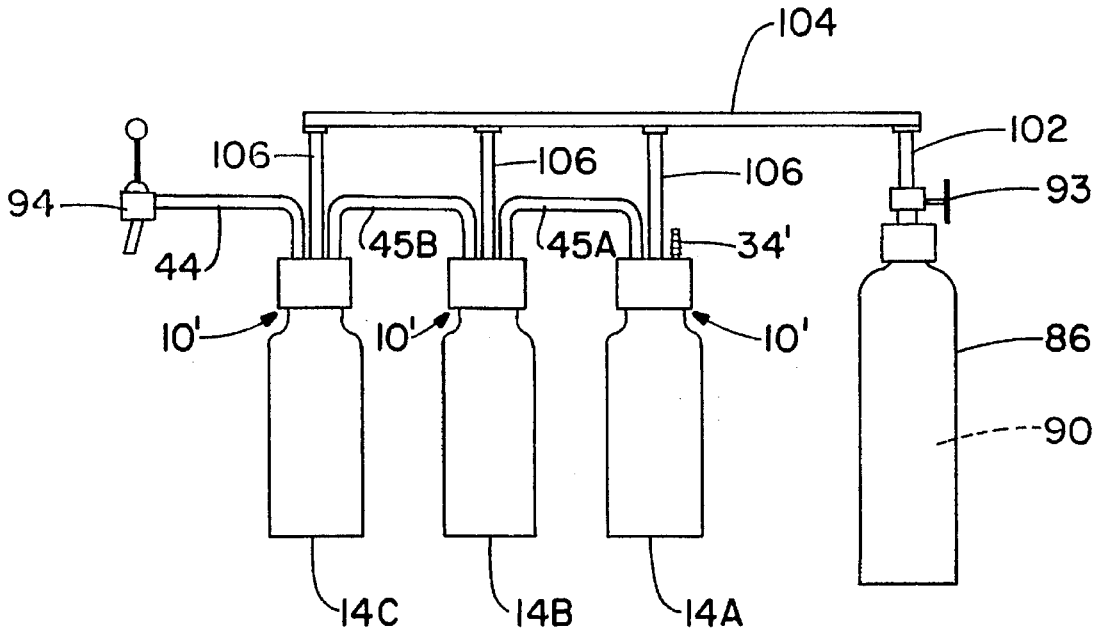
FIG. 6 is a view illustrating the pressurizing and drafting assembly of FIGS. 4 and 5 in conjunction with a series of containers.

FIG. 4 illustrates a pressurizing and drafting assembly 10' according to an alternative embodiment of the present invention. Assembly 10' is the same as assembly 10, with the following exception. Assembly 10' includes a nipple assembly 26' having first and second nipples 34' and 35', respectively. Nipples 34' and 35' each include an outer portion 36' which comprises a substantially straight tube and, unlike the outer portion 36 of nipples 34 and 35 of assembly 10, does not include barb fittings 40. Additionally, unlike nipple assembly 26, nipple assembly 26' further includes a third nipple 96 which is attached to body section 32' of nipple assembly 26'. Nipple 96 includes an outer portion 98 which protrudes from an outer surface 38' of nipple assembly 26', extending externally of container 14, and an internal portion (not shown) disposed within neck 12 of container 14. As with outer portions 36' of nipples 34' and 35', the outer portion 98 of nipple 96 comprises a substantially straight tube. Outer portions 36' of nipples 34' and 35', as well as outer portion 98 of nipple 96 do not include barb fittings in order to accommodate the manufacture of nipple assembly 26' as a one-piece construction of molded plastic. Outer portions 36' and 98 are configured so as to permit attachment of a pressurized tube, which is preferably a flexible tube or hose but alternatively may be a rigid or semi-rigid tube, to the respective ones of nipples 34', 35' and 96. In addition to the frictional fit between the tubes and nipples 34', 35' and 98, tube clamps (not shown) may be used to further secure the tubes to the respective nipples. As shown in FIG. 5, nipples 34', 35' and 96 are arranged in a triangular pattern on nipple assembly 26'. Nipple 96 includes an interior flow passage 100 which extends through outer portion 98 and the inner portion of nipple 96. Nipple assembly 26' also includes a center post 58' protruding from the inner surface 50' of body section 32' and a radially extending tab 59' which is attached to center post 58' and is disposed inward of check valve 76. Center post 58' and tab 59' function in the same manner as center post 58 and tab 59 of assembly 10. The, remaining elements of assembly 10' are the same as those of assembly 10 and include annular seal 66, check valve 76, hollow draw tube 68 and cap 20. The steps for assembling the elements of assembly 10' are exactly the same as those required to assemble the elements of assembly 10. When assembled, the inner portion of nipple 96 is disposed in abutting relationship with check valve 76, in the identical manner as the inner portion of nipple 34'. Accordingly, gas may enter cavity 92 of container 14 through nipple 34' or nipple 96, but may not exit container 14 through nipple 34' or nipple 96. Assembly 10' may be used to pressurize and draft liquid 16 contained within a single one of containers 14 by attaching one end of a tube to either nipple 34' or nipple 96 and the other end to external source of gas, and by attaching another tube between nipple 35' and a dispensing device. No connection is required to the remaining one of nipples 34' and 96.

Although assembly 10' may be utilized to pressurize and draft liquid from a single container, assembly 10' may be most advantageously used to simultaneously carbonate liquid contained within a series of containers 14 and subsequently draft the liquid 16 contained therein. The method steps required to accomplish this may be illustrated with reference to FIGS. 4 and 6. As a first step in the method for pressurizing and drafting liquid from the series of containers 14, the constituent elements of each assembly 10', comprising nipple assembly 26', check valve 76, seal 66, draw tube 68 and cap 20 are preassembled to one another as discussed in previous paragraphs regarding assembly 10. Although not shown in detail in FIG. 6, containers 14A, 14B and 14C each include external threads 82 formed on the corresponding neck portion 12. As a next step, each of the assemblies 10' are attached to the corresponding one of the containers 14A, 14B and 14C by screwing the cap 20 of each assembly 10' onto the neck portion 12 of the corresponding one of the containers 14, so that the internal threads 24 of each cap 20 engage the external threads 82 of the corresponding one of the containers 14. Next, tubes 45A, 45B and 44 are installed as discussed previously with respect to the plumbing arrangement illustrated in FIG. 3. Accordingly, tube 45A is connected between nipple 35' of the assembly 10' attached to container 14A and nipple 34' of the assembly 10' attached to container 14B. Similarly, tube 45B extends between nipple 35' of the assembly 10' attached to container 14B and nipple 34' of the assembly 10' attached to container 14C. Tube 44 is attached to nipple 35' of the assembly 10' attached to container 14C and to the dispensing device comprising faucet 94. Unlike the plumbing arrangement illustrated in FIG. 3, a parallel fluid flow communication is established between the external source of gas 86 and the pressurizing and drafting assembly 10' attached to each of the containers 14A, 14B and 14C. This is accomplished by attaching a first end of a tube 102 to the output of pressure regulator 93 and attaching the other end of tube 102 to a flow manifold 104. Next, a tube 106 is attached to manifold 104 and nipple 96 of each of the assemblies 10'. Accordingly, gas 90 may flow out of the external source 86 through tube 102 into manifold 104 and through each of the tubes 106 into the cavity 92 within the corresponding one of containers 14A, 14B and 14C. In this manner, the liquid 16 within each of the containers 14A, 14B and 14C may be simultaneously carbonated by allowing the $CO_2$ to bubble through the liquid 16 within each of the containers 14 for a predetermined period of time prior to the step of drafting the liquid 16 from one or more of the containers 14. It should be understood that the roles of nipples 34' and 96 may be interchanged such that tubes 106 may be attached to nipples 34' with one end of tubes 45A and 45B attached to the corresponding one of nipples 96. In either plumbing arrangement, no connection is required to one of the nipples 34' and 96 of the assembly 10' attached to container 14A.

Figure 7:
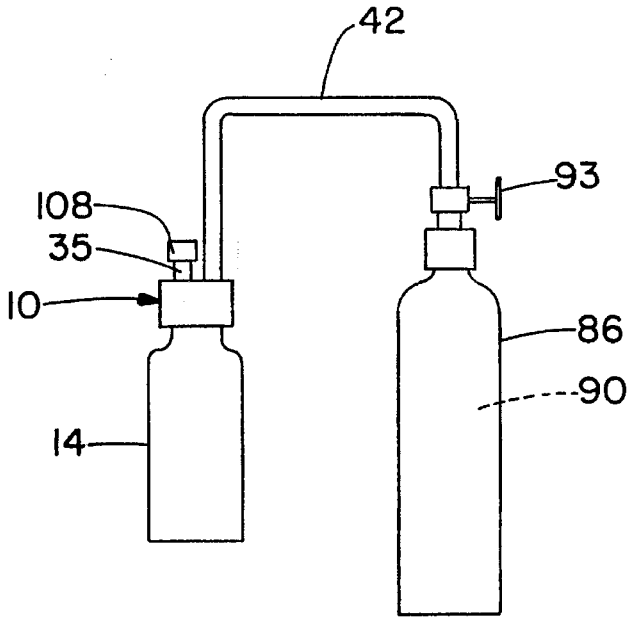
FIG. 7 is a view illustrating a method for creating a portable source of pressurized gas using elements of the pressurizing and drafting assembly of the present invention.

FIG. 7 illustrates a plumbing arrangement which permits assembly 10 to be utilized to create a portable source of pressurized gas, such as $CO_2$. Assembly 10' may also be utilized in this manner. The container 14 illustrated in FIG. 7 is completely void of liquid. As a first step, the constituent elements of assembly 10, or alternatively assembly 10', are assembled to one another and then attached to container 14 according to the previously described steps with the exception that draw tube 68 may be omitted. Next a cap is installed over the outer portion 36 of nipple 35 so as to prevent fluid from escaping the interior of container 14 through nipple 35. Next, tube 42 is attached, or connected, to the output of pressure regulator 93 and to nipple 34 of assembly 10. If assembly 10' is utilized, nipple 35' is capped so as to prevent fluid from escaping the interior of the container through nipple 35' and tube 42 is connected or attached to one of nipple 34' and 96 with no connection being made to the other of nipples 34' and 96. Next, the pressure regulator 93 is set at the desired pressure setting and gas 90 is flowed from the external source of gas 86 through tube 42 and nipple 34, or 34' when assembly 10' is used, into the interior of container 14. Tube 42 may then be removed from nipple 34, with container 14 then becoming a convenient portable source of $CO_2$. If desired, pressurized container 14 may be used to pressurize containers 14A, 14B, and 14C shown in FIGS. 3 and 6, in place of the external source of gas 90. Additionally, pressurized container 14 may be used for other purposes as desired.

While the foregoing description has set forth the preferred embodiments of the invention in particular detail, it must be understood that numerous modifications, substitutions and changes can be undertaken without departing from the true spirit and scope of the present invention as defined by the ensuing claims. For instance, although cap 20 and nipple assembly 26, as well as cap 20 and nipple assembly 26', have been illustrated as separate parts, cap 20 and either nipple assembly 26 or nipple assembly 26' may be made as a one-piece construction of molded plastic. In this instance, the one-piece unit would be screwed onto the neck portion of the container in the same manner as cap 20. Additionally, with such a one-piece construction of cap 20 and either assembly 26 or 26', the outer portion of nipple 35 or 35' may comprise a conventional dispensing device such as a faucet. The invention is therefore not limited to specific preferred embodiments as described but is only limited as defined by the following claims.

What is claimed is:

1. An apparatus for use in pressurizing a liquid contained within an interior portion of a container and drafting the liquid from the container which includes a neck portion having external threads, said apparatus comprising:

a cap having a generally cylindrical body section and internal threads formed on said body section which are adapted to threadingly engage the external threads of the neck portion of the container and an annular flange attached to and protruding radially from said body section toward a central opening;

a fluid fitting assembly extending through said central opening in said cap and adapted to be secured to the neck portion by said cap, said fluid fitting assembly including a body section and a nipple assembly having an annular flange attached to and circumventing said body section of said nipple assembly, said annular flange of said nipple assembly being disposed inward of and in radially overlapping relationship with said annular flange of said cap, said nipple assembly including a first nipple for accepting a fluid from an external source for injection into the container and a second nipple for dispensing fluid from the container;

a draw tube having a first end attached to said second nipple, a second end immersed in the liquid, and an interior flow passage extending longitudinally between said first and second ends;

wherein said first nipple and said second nipple each include an outer portion attached to and protruding from an outer surface of said body section and adapted to be disposed externally of the container, an inner portion attached to and protruding from an inner surface of said body section within the interior portion of the container and an interior flow passage extending longitudinally through said inner and outer portions of the corresponding one of said first nipple and said second nipple, said interior flow passage of said first nipple is in fluid communication with the external source of the fluid and with the interior portion of the container and said interior flow passage of said second nipple is in fluid flow communication with said interior flow passage of said draw tube such that said draw tube and said second nipple combine to permit at least a portion of the liquid to be dispensed from the container through said exterior portion of said second nipple, said inner portion of said first nipple is disposed above the liquid within the container;

an annular seal surrounding said body section of said nipple assembly and disposed inward of said annular flange of said nipple assembly, said annular flange of said cap urges said annular seal into sealing engagement with said annular flange of said nipple assembly and the neck portion of the container when said cap is screwed onto the neck portion;

a check valve having first and second spaced apart holes extending therethrough disposed within the neck portion of the container and attached to said nipple assembly, said check valve having a generally circular shape and being fabricated from a resilient material which is substantially impermeable to the flow of fluid therethrough, said check valve flexes way from said inner portion of said first nipple so as to permit fluid to flow through said interior flow passage of said first nipple into the interior portion of the container when the pressure within said interior flow passage of said first nipple exceeds the pressure within the container by a predetermined differential pressure and said check valve is urged against said inner portion of said first nipple so as to close said interior flow passage of said first nipple thereby preventing fluid to flow outward through said first nipple when the pressure within the container exceeds the pressure within said interior flow passage of said first nipple;

a center post protruding from an inner surface of said body section of said nipple assembly and extending through one of said first and second holes and said inner portion of said second nipple extends through the other of said first and second holes; and means for retaining said check valve.

2. The apparatus as recited in claim 1, wherein said resilient material of said check valve comprises an elastomeric material.

3. The apparatus as recited in claim 1, wherein said means for retaining said check valve comprises at least one outwardly facing barb fitting integral with said inner portion of said second nipple and disposed inward of said check valve.

4. The apparatus as recited in claim 1, wherein said outer portion of said first nipple comprises a plurality of inwardly facing barb fittings, said barb fittings being operable for receiving a tube.

5. The apparatus as recited in claim 4, wherein said barb fittings of said first nipple have a generally frusto-conical shape, said barb fittings cooperating with a flexible hose attached thereto so as to avoid an over-pressure condition within the container.

6. The apparatus as recited in claim 1, wherein said outer portion of said second nipple includes a plurality of inwardly facing barb fittings, said barb fittings permitting a tube to be attached to said second nipple.

7. The apparatus as recited in claim 1, wherein said nipple assembly is a one-piece construction made of molded plastic.

8. The apparatus as recited in claim 1, wherein:

said nipple assembly further includes a third nipple attached to said body section; and said third nipple includes an outer portion attached to and protruding from said outer surface of said body section and disposed externally of the container and an inner portion attached to and protruding from said inner surface of said body section within the interior portion of the container.

9. The apparatus as recited in claim 8, wherein:

said third nipple includes an interior flow passage extending longitudinally through said outer and winner portions of said third nipple; and said interior flow passage of said third nipple is in fluid flow communication with the external source of the fluid and with the interior portion of the container.

10. The apparatus as recited in claim 9, wherein:

said inner portion of said third nipple is disposed within the neck portion of the container above the liquid.

11. A method for pressurizing and drafting a fluid contained within and partially filling a food-grade container which includes a neck portion having external threads, said method comprising the steps of:

(A) assembling a pressurizing and drafting assembly by installing a check valve onto a nipple assembly having a first nipple and a second nipple attached to a body section of said nipple assembly, each of said first nipple and said second nipple having an outer portion protruding externally of the container, an inner portion disposed within the container and an interior flow passage extending through said outer and inner portions into a generally cylindrical section of a cap, said body section having internal threads thereon, by forcing said inner portion of said second nipple through a first hole formed in said check valve;

(B) inserting a center post which is attached to said body section of said nipple assembly and a tab attached to said center post through a second hole formed in said nipple assembly;

(C) disposing said check valve in abutting relationship with said inner portion of said first nipple so as to allow fluid to pass through said first nipple into the container and two prevent fluid from escaping the container through said first nipple;

(D) attaching a first end of a hollow draw tube to said inner portion of said second nipple;

(E) pressing a seal into said cap in surrounding relationship with said body section of said nipple assembly:

(F) attaching the pressurizing and drafting assembly to the neck portion of the container by screwing said cap onto the neck portion of the container so as to attach said body section of said nipple assembly and said seal to the neck portion and to dispose a second end of draw tube within the liquid in the container;

(G) pressurizing the liquid within the container with gas from an external source of gas by attaching a tube to said outer portion of said first nipple and to the external source of gas and injecting gas from the external source of gas through said interior flow passage of said first nipple into a cavity within the interior of the container, said cavity being located outward of and in fluid flow communication with the liquid within the container; and (H) drafting at least a portion of the liquid from the container.

12. The method as recited in claim 11, wherein said step of drafting comprises the steps of:

(A) connecting a tube to said outer portion of said second nipple and to a dispensing device;

(B) opening said dispensing device.

13. The method as recited in claim 11, wherein the external source of gas comprises an external source of pressurized $CO_2$ and wherein said step of pressurizing comprises the steps of:

(A) carbonating the liquid within the at least one container, said step of carbonating comprising the steps of:

(i) injecting $CO_2$ through said interior flow passage of said first nipple into the cavity within the container outward of the liquid;

(ii) permeating the $CO_2$ into the liquid for a predetermined period of time before completing said step of drafting.

14. The method as recited in claim 11, wherein the external source of gas comprises an external source of pressurized inert gas and wherein said step of pressurizing comprises the step of:

injecting inert gas from said external source of inert gas through said interior flow passage of said first nipple into the cavity within the container outward of the liquid.

15. The method as recited in claim 11, wherein the external source of gas comprises an external source of pressurized air and wherein said step of pressurizing comprises the step of:

injecting air from the external source of pressurized air through said interior flow passage of said first nipple into the cavity within the container outward of the liquid.

16. A method for pressurizing and drafting liquid contained within each of a series of food-grade containers, each container having a neck portion with external threads formed thereon, said method comprising the steps of:

assembling a plurality of pressurizing and drafting assemblies, wherein the number of pressurizing and drafting assemblies is equal to the number of containers, by installing a check valve onto a nipple assembly having a plurality of nipples attached to a body section, each nipple having an outer portion protruding externally of the corresponding container, an inner portion disposed within the corresponding container and an interior flow passage extending through said outer and inner portions;

(B) inserting said nipple assembly and said check valve into a generally cylindrical body section of a cap in abutting relationship with said inner portion of a first one of said nipples so as to allow fluid to pass through said first nipple into the corresponding container and to prevent fluid from escaping the corresponding container through said first nipple, said body section having internal threads formed thereon;

(C) pressing a seal into said cap in surrounding relationship with said body section of aid nipple assembly;

(D) attaching a first end of a hollow draw tube to an inner portion of a second one of said nipples;

(E) positioning said inner portion of a third one of said nipples in abutting relationship with the corresponding one of said check valves so as to permit fluid to flow through said interior flow passage of said third nipple into the corresponding container and to prevent fluid from escaping the corresponding container through said third nipple to provide a parallel fluid flow communication between the external source of $CO_2$ and said pressurizing and drafting assembly attached to each one of the containers;

(F) said method further including the step of repeating the above steps (A) through (E) for each of said pressurizing and drafting assemblies;

(G) said step of coupling comprises the step of attaching a tube to the outer portion of said first nipple which is attached to the first container of the series of containers and to the external source of $CO_2$;

(H) screwing said cap onto the neck portion of the container so as to attach said body section of said nipple assembly and said seal to the neck portion and to dispose a second end of said draw tube within the liquid in the container;

(I) repeating the above step (H) for each of the containers of the series of containers:

(J) coupling said pressurizing and drafting assembly attached to the first one of the series of containers with an external source of pressurized $CO_2$;

(K) providing a series fluid coupling of said pressurizing and drafting assemblies so as to establish a liquid flow communication of the liquid contained in any one of the containers of the series of containers with the liquid contained in each of the successive downstream ones of the containers by attaching a tube to said outer portion of said second nipple of said nipple assembly which is attached to any one of the containers of the series of containers and said outer portion of said first nipple of said nipple assembly which is attached to the next consecutive downstream one of the containers of the series of containers;

(L) repeating the above step (K) for each adjacent pair of upstream and downstream containers;

(M) pressurizing the liquid contained within the containers while simultaneously carbonating the liquid contained within each of the containers of the series of containers; and (N) drafting liquid from at least one of the containers by attaching a tube to a dispensing device and to said outer portion of said second nipple of said nipple assembly which is attached to the last container of the series of containers and opening said dispensing device.

17. The method as recited in claim 16, wherein said step of pressurizing comprises the step of:

flowing pressurized gas from the external source of gas through said first nipple of said nipple assembly which is attached to the first container of the series of containers into the interior of the first container above the liquid contained therein.

18. A method for creating a portable source of pressurized gas, said method comprising the steps of:

(A) obtaining a container having a neck portion with external threads formed thereon;

(B) attaching a nipple assembly to the external threads of the neck portion of the container, said nipple assembly including a body section and a plurality of nipples attached to said body section, each of said having an interior flow passage extending longitudinally therethrough and in fluid flow communication with an interior portion of the container;

(C) installing a check valve inward of and in abutting relationship with said body section so as to permit gas to flow through a first one of said nipples into the interior portion of the container and to prevent gas from escaping the interior portion of the container through said first nipple;

(D) sealing said body section so as to prevent gas from leaking between said body section and the neck portion of the container;

(E) fluidly connecting an exterior portion of said first nipple to an external source of gas having a static pressure;

(F) capping an exterior portion of the remaining ones of said nipples;

(G) opening an output means of the external source of gas and pressurizing the interior of the container to a predetermined pressure which is less than the static pressure of the external source of gas; and (H) disconnecting the fluid connection between said first nipple and the external source of gas.

19. The method as recited in claim 18, wherein said step of obtaining comprises the step of obtaining a plastic container having a liquid storage capacity ranging from about 0.2 liters to about 4.0 liters.

20. The apparatus as recited in claim 1, wherein:

said nipple assembly further includes a radially extending tab attached to said center post, said tab being disposed inward of said check valve.

21. The apparatus as recited in claim 8, wherein said outer portion of said first, second and third nipples comprises a substantially straight tube.

* * * * *